US005320358A

United States Patent [19]

Jones

[11] Patent Number: 5,320,358

[45] Date of Patent: Jun. 14, 1994

[54] SHOOTING GAME HAVING PROGRAMMABLE TARGETS AND COURSE FOR USE THEREWITH

[75] Inventor: Michael A. Jones, Brodhead, Wis.

[73] Assignee: RPB, Inc., Brodhead, Wis.

[21] Appl. No.: 54,398

[22] Filed: Apr. 27, 1993

[51] Int. Cl.[5] ..... A63F 9/02; A63B 67/00

[52] U.S. Cl. ..... 273/313; 273/316; 273/371; 434/16

[58] Field of Search ..... 273/313, 316, 312, 85 G, 273/460, 314, 315, 371, 374; 434/11, 16, 20, 21

[56] References Cited

U.S. PATENT DOCUMENTS 1,880,138 9/1932 Hubl .
3,582,077 6/1971 Parker .
3,843,127 10/1974 Lack .
4,141,175 2/1979 Barlow et al. .
4,340,370 7/1982 Marshall et al. .
4,487,583 12/1984 Brucker et al. .
4,695,058 9/1987 Carter, III .
4,889,210 12/1989 Alcaraz et al. .
4,934,937 6/1990 Judd .
4,948,371 8/1990 Hall .
5,021,878 6/1991 Lang .
5,100,153 3/1992 Welte .
5,127,657 7/1992 Ikezawa et al. ..... 273/313

FOREIGN PATENT DOCUMENTS 0534712 3/1993 European Pat. Off. ..... 273/313
1118015 7/1968 United Kingdom .

*Primary Examiner*—Jessica J. Harrison
*Attorney, Agent, or Firm*—Ross & Stevens

[57] ABSTRACT

The shooting game includes programmable flip-up targets spaced along a game course, and sensors associated with the targets that detect the presence of a player near the associated target. A. programmable main controller transmits skill level control instructions to each of the target controllers. The target controllers cause the targets to fire paint balls or other items at the player in accordance with the selected skill level. The game may be played indoors or outdoors by one or more players.

19 Claims, 6 Drawing Sheets

SHOOTING GAME HAVING PROGRAMMABLE TARGETS AND COURSE FOR USE THEREWITH

BACKGROUND OF THE INVENTION

This invention relates to shooting games. More particularly, this invention relates to shooting games in which a player travels through a course and shoot at targets.

Games are known in which two or more players travel along a path on a course and fire items such as paint balls, light beams, or dummy ammunition at each other. These games may be played on an indoor or an outdoor course. In either case, these games require at least two opponents or teams of opponents. A single player typically cannot play the game.

Other shooting games are known that use so-called "flip-up" targets. A player fires an item at a specific target surface of the target; a means is provided for keeping score based upon the number of times that the player successfully hits one or more targets. In these types of games, the player typically remains in a single position or within a prescribed area when shooting at the targets instead of traversing a course.

SUMMARY OF THE INVENTION

A unique game is provided which may be played on an indoor or on an outdoor course by one or more players. The game is programmable to different skill levels; the game is controlled by a main controller and by a plurality of controllers associated with targets placed at various locations along the course.

In a preferred embodiment, the game includes a main controller having programmed instructions corresponding to a variety of skill levels. Before the game is begun, the game operator or the player himself selects one or more skill levels at which the game will be played by the player.

The game also includes a sensing means, comprising a plurality of sensors, for sensing the presence of the player as he travels along the game course. The sensors are preferably photoelectric devices with associated reflectors that sense whether a light beam has been broken by the player. Each of the sensors has one or more targets associated with it. When a sensor is tripped by the player, a signal is sent by the sensor to the main controller or to the sensor's associated target.

Each target preferably includes a means for receiving a control signal from the main controller that instructs the target to fire its firing means in response to a sensing signal from the associated sensor. The firing means fires an item towards the player when the presence of a player is sensed by the associated sensor. In a preferred embodiment, the target also includes a target control means having programmed instructions which control the operation of the firing means in accordance with different skill levels.

Each of the targets also includes a target surface at which the player fires an item, and a means for detecting whether a player has successfully struck the target surface with an item. A computing means computes a score for the player based at least in part upon the number of times that the detection means detects that the player has successfully struck the target surfaces of the targets with an item.

Also in a preferred embodiment, each target includes a movable structural element such as a flip-up target surface, and a motor or other means for moving the structural element in response to a control signal from the main controller.

It is a feature and advantage of the present invention to provide a realistic shooting game that may be played by a single player.

It is yet another feature and advantage of the present invention to provide a realistic shooting game that is programmable to different skill levels.

It is yet another feature and advantage of the present invention to provide a shooting game which detects the presence of a player in a particular location along a game course, and that fires paint balls or other items at the player to simulate a realistic war game.

It is yet another feature and advantage of the present invention to provide a war game having a plurality of targets that are controlled by a main controller.

It is yet another feature and advantage of the present invention to provide targets for a shooting game which themselves are programmable.

These and other features and advantages of the present invention will be apparent to the skilled in the art from the following detailed description of the preferred embodiments and the drawings, in which:

DETAILED DESCRIPTION OF THE PREFERRED EMBODIMENTS

Figure 1:
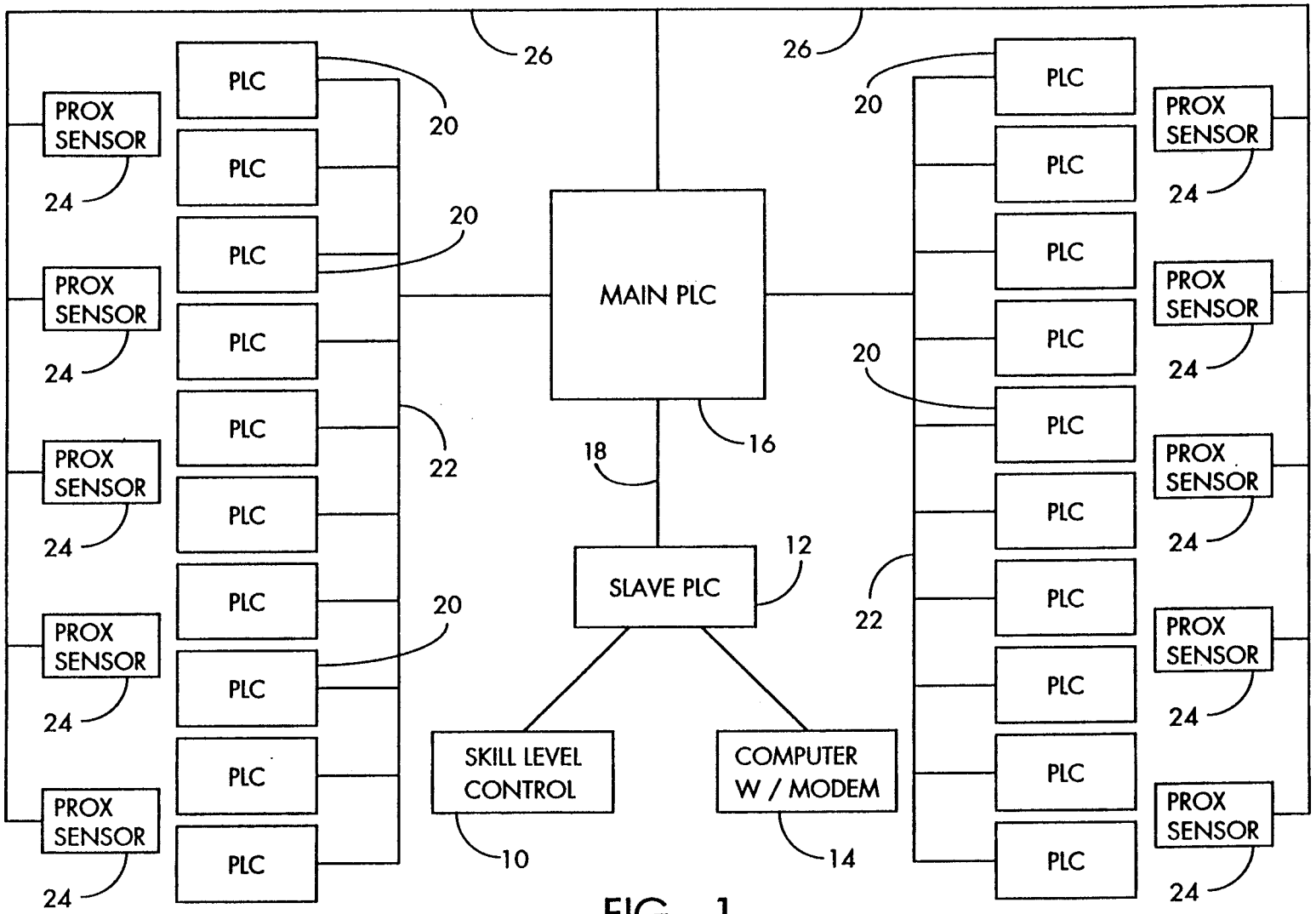
FIG. 1 is a schematic diagram of the control system of the present invention.

FIG. 1 is a block diagram of the control system of the present invention. In FIG. 1, the skill level to be used for a particular player of the game is input at a skill level control 10, which is connected to slave programmable logic controller (PLC) 12. Also interconnected with slave PLC 12 is an IBM compatible computer and modem assembly 14. Computer 14 is used as an input device for the program instructions. The computer is also used as an output device to display the selected skill level and course option information, and to display the scores to all the players as the players leave the course.

Slave PLC 12 has several functions. One of the functions of slave PLC 12 is to receive skill level information. Another function is to instruct main PLC 16 to operate the game in accordance with one of several programs stored in main PLC 16. Another function of slave PLC 12 is to operate several indicator lights (not shown). These lights may include start and stop lights which tell the player whether to enter the course, and a yellow light which informs a player that he is qualified to proceed to the next skill level. Slave PLC 12 may also execute a security program for admissions building 28 (FIG. 2), and may translate security information from targets 20 and main PLC 16 for transmission to computer 14.

Examples of the types of programs which may be stored in main PLC 16 include programs which determine which of targets 20 will be raised and at what times, the particular lighting that will be used for the game, and instructions to each of targets 20 as to how the targets should operate for the individual player.

Main PLC 16 in interconnected with flip-up targets 20 via cables 22. In the alternative, main PLC 16 may have one or more transmitters which transmit signals to receivers associated with targets 20. Each of targets 20 preferably has its own PLC associated therewith, as more fully explained below. Each of the target PLC's is capable of storing one or more programs which affect its operation.

As used herein, the term "programmable logic controller" and "PLC" refer in the broad sense to any logic controller capable of storing program instructions, regardless of whether the controller is truly programmable or whether it is preprogrammed. A programmable microprocessor is one example of a PLC, although dedicated processors and programmable logic arrays (PLA) may also be used.

Associated with targets 20 are a plurality of proximity sensors 24. Each of proximity sensors 24 is associated with one or more targets 20. Sensors 24 sense the presence of a player in the vicinity of one or more of targets 20, and relate the sensing information to main PLC 16 via lines 26. In the alternative, proximity sensors 24 may be directly connected to one or more of their associated targets 20, so that tripping a sensor 24 directly affects the operation of its associated targets 20. The embodiment depicted in FIG. 1 is preferred, however, since it enables main PLC 16 to program the associated targets 20 as well as other targets further down the course in response to the output signal of a single sensor 24. Sensors 24 may include any of a variety of proximity sensors such as photoelectric eyes and reflector combinations, magnetic sensors, sonar sensors, and the like.

Figure 2:
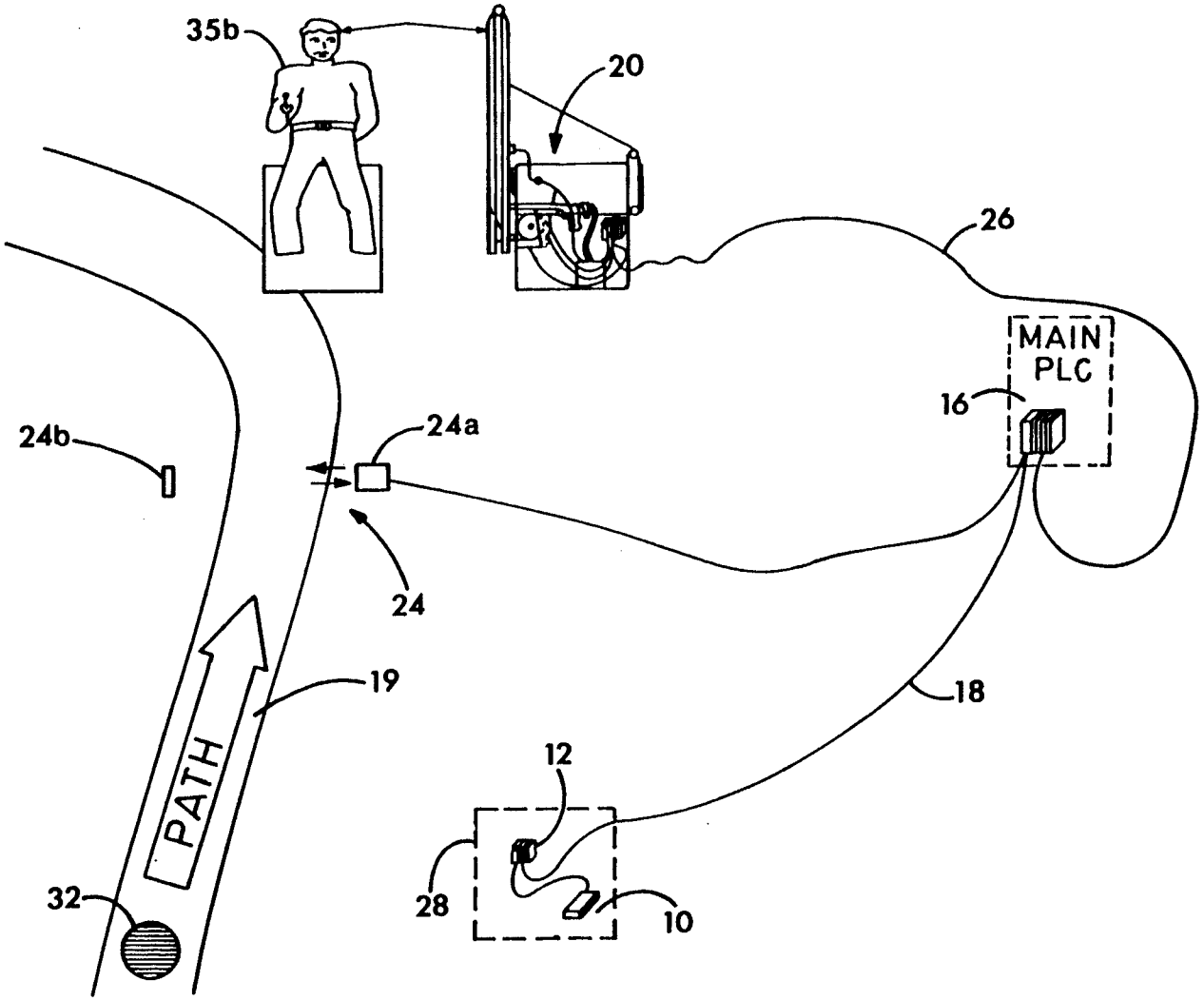
FIG. 2 is a diagram depicting the sensor and control system of the present invention.

FIG. 2 also depicts the control system used with the game of the present invention. In FIG. 2, an admissions building 28 at the start of course 30 (FIG. 6) includes slave PLC 12 and skill level 10. Main PLC 16 may be placed at a remote location, closer to one or more of targets 20. Main PLC 16 may also be placed at a central location. Sensor 24 is placed across a path 19 of the course, and includes a radiation emitting device 24*a* and a reflector 24*b*. Player 32 proceeds along path 19, tripping a sensor 24 along the way, and shooting at a target 20 after the target flips up.

Figure 3A:
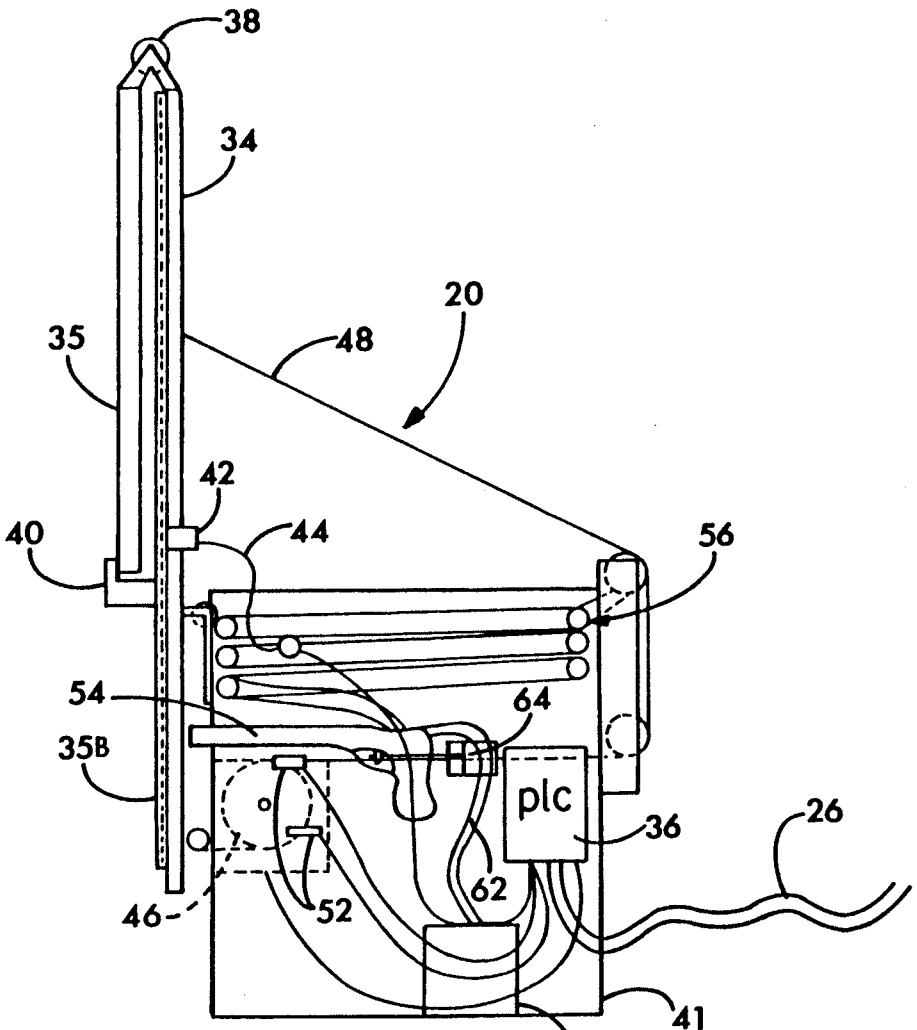
FIG. 3*a* is a side view of a programmable target according to the present invention, shown in partial section.
Figure 3B:
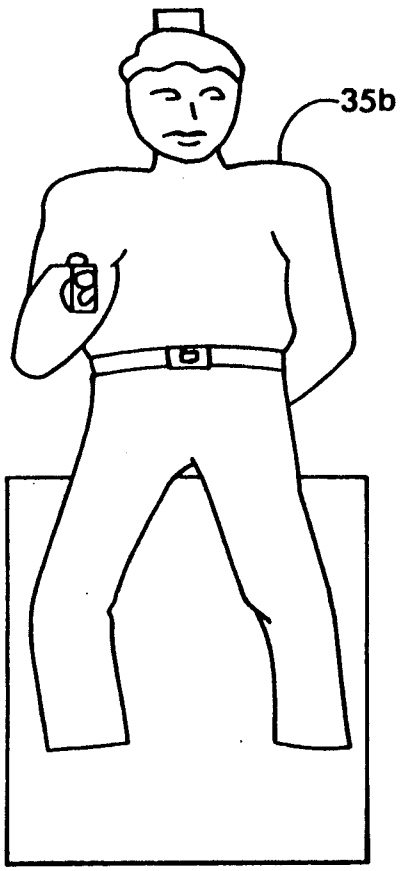
FIG. 3*b* is a front view of the target depicted in FIG. 3*a*.

FIG. 3*a* is a side cross-sectional view that more clearly depicts a first embodiment of a programmable target 20. FIG. 3*b* is a front view of the target of FIG. 3*a*. In FIGS. 3*a* and 3*b*, target 20 includes a structural element 34 that may be raised or lowered in response to control signals from either main PLC 16 or target PLC 36. Structural element 34 preferably includes a target surface 35 that is connected to the target at a hinge 38. Positioning block 40 retains target surface 35 in place. Target 20 also includes a target silhouette 35*b* (FIG. 3*b*) which preferably resembles a human figure. Housing 41 encloses most of the mechanical and electrical components of target 20.

When the player fires an item such as a paint ball, he attempts to strike target surface 35 with the item. If the player strikes target surface 35, target surface 35 will deflect rearward, causing proximity switch 42 associated therewith to be tripped. When switch 42 is tripped, a signal is sent along wire 44 to PLC 36 and then to main PLC 16 via cable 26. Main PLC 16 then computes a score for the player that includes crediting the player with a hit on target 20.

Structural element 34 is raised and lowered by a motor 46 and one or more cables or chains 48. Target PLC 36, in response to control signals from main PLC 16, activates one of switches 52 to control the starting, stopping and direction of motor 46. In a preferred embodiment, structural element 34 is flipped up to expose target surface 35 when an associated sensor 24 detects the presence of a player near the particular target 20.

Each of the targets 20 also includes a means for firing an item at the player in a programmed manner. In a preferred embodiment, the firing means includes a gun 54, a magazine 56 for storing rounds of paint balls or other ammunition, and a tank 58 of a pressurized gas such as carbon dioxide. A pressure line 62 connects gun 54 to a triggering mechanism 64.

The operation of the firing mechanism is preferably controlled by target PLC 36, although it may be controlled by main PLC 16. In either case, the firing means operates in accordance with the selected skill level. Some examples of skill levels include:

a). Practice Level

At this skill level, target 20 flips up and waits for a predetermined time for the player to shoot at target surface 35. If no successful hit is detected by proximity switch 42 within the selected time, the target flips back down without activating the firing mechanism.

b). Intermediate Skill Level

At this skill level, the target flips up, and waits a predetermined time for the player to successfully hit the target surface. If no successful hit is detected, the target returns two rounds of ammunition.

c). Pro Level

At this skill level, a target in front of the player flips up and waits a predetermined time for the player to attempt to successfully hit the target surface. During this waiting period, a second target behind the player associated with the same sensor flips up and begins its own timing cycle. After each target's timing cycle ends, that target fires one or more rounds of ammunition at the player.

d). Sudden Death Level

Both targets associated with the same trip sensor, one in front of the player and one behind the player, are flipped up at about the same time. They both start their respective timing cycles, but both targets return fire immediately without waiting for the player to shoot at them first.

At each skill level, the proximity sensor tripped by the player along the course causes main PLC 16 to start a program stored in the target's PLC 36. The target's PLC 36 causes target surface 35 to become visible to the player and, depending upon the skill level, waits a predetermined time for the player to score. The target's PLC also controls the return fire by the target, if any. After the target's cycle has been completed, motor 46 returns structural element 34 to its down position, and target 20 resets for the next player.

Figure 5:
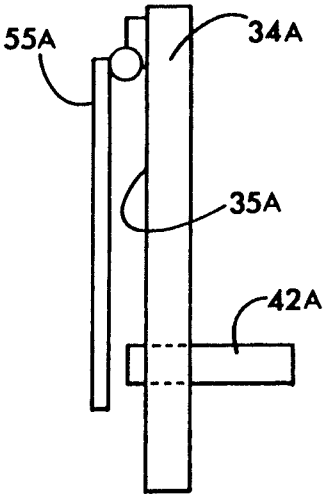
FIG. 5 is a side view depicting the target surface proximity sensor according to the present invention.
Figure 4:
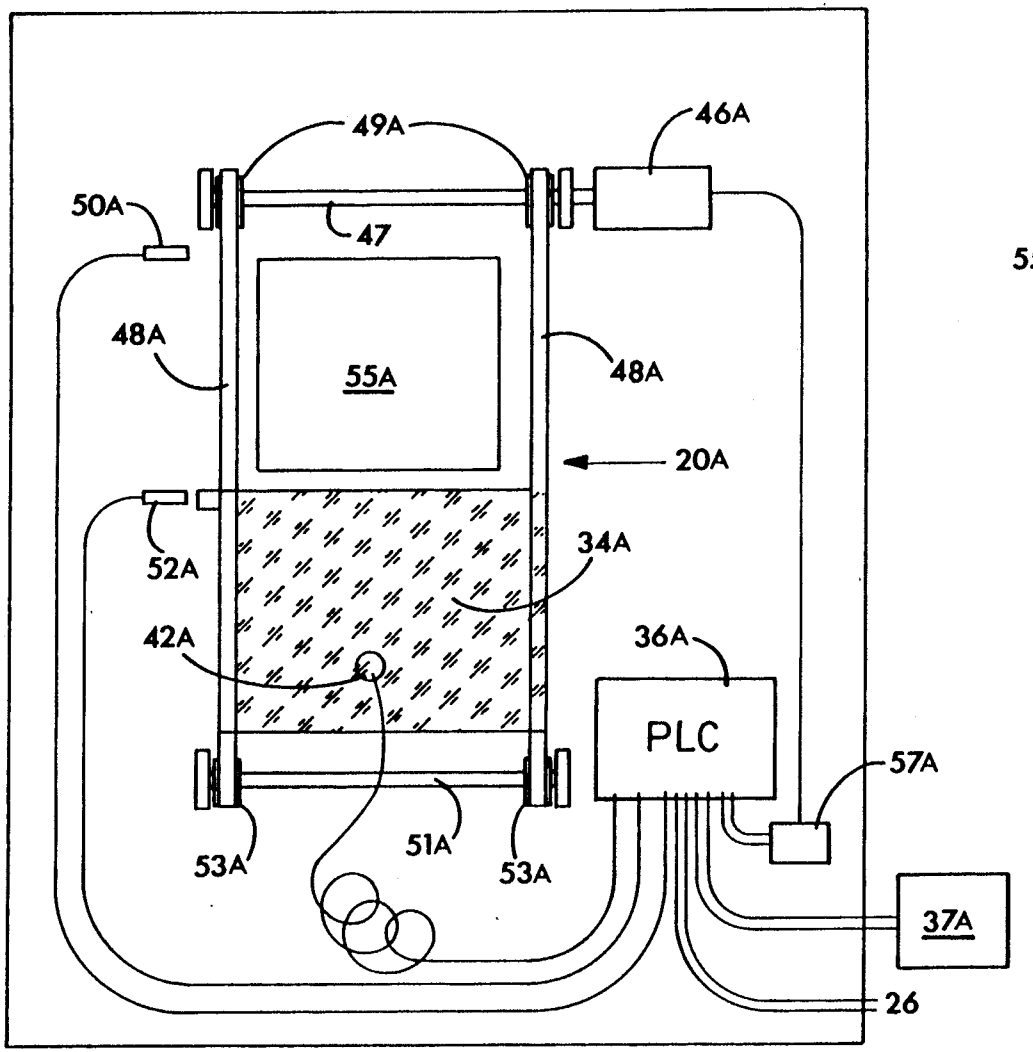
FIG. 4 is a rear view of an alternate target.

FIGS. 4 and 5 depict a second version of the target, which is preferred for an indoor course since less space is required by each target. In FIGS. 4 and 5, target 20a includes a motor 46a, a pair of spaced cables or chains 48a, a structural element 34a that is movable along the vertical direction, a PLC 36a that is powered by a power source 37a, and a pair of start and stop proximity switches 52a and 50a, respectively. The shaft of motor 46a is connected to a rotatable rod 47 having a pair of spaced pulleys 49a disposed thereon. At the lower end of the target is a rotatable shaft 51a having a pair of spaced pulleys 53a. Target 20a also has a plexiglass or glass window 55a. A controller 57a controls the direction of motor 46a. A hit proximity sensor 42a (FIG. 5) detects whether the player has successfully struck the target with an item.

The second embodiment depicted in FIGS. 4 and 5 operates in the following manner. In response to a control signal from either main PLC 16 or target PLC 36a, motor 46a begins to rotate in a clockwise direction, thereby rotating shaft 47. Cables 48a raise structural element 34a behind window 55a so that target surface 35a is visible to the player. If the player'successfully strikes window 55a with a paint ball or other item, the window 55a will deflect inwardly a sufficient amount to activate proximity sensor 42a. Sensor 42a informs PLC 36a and/or main PLC 16 that a successful hit has occurred. Thereafter, motor controller 57a reverses the direction of motor 46a, thereby lowering structural element 34a.

Figure 6:
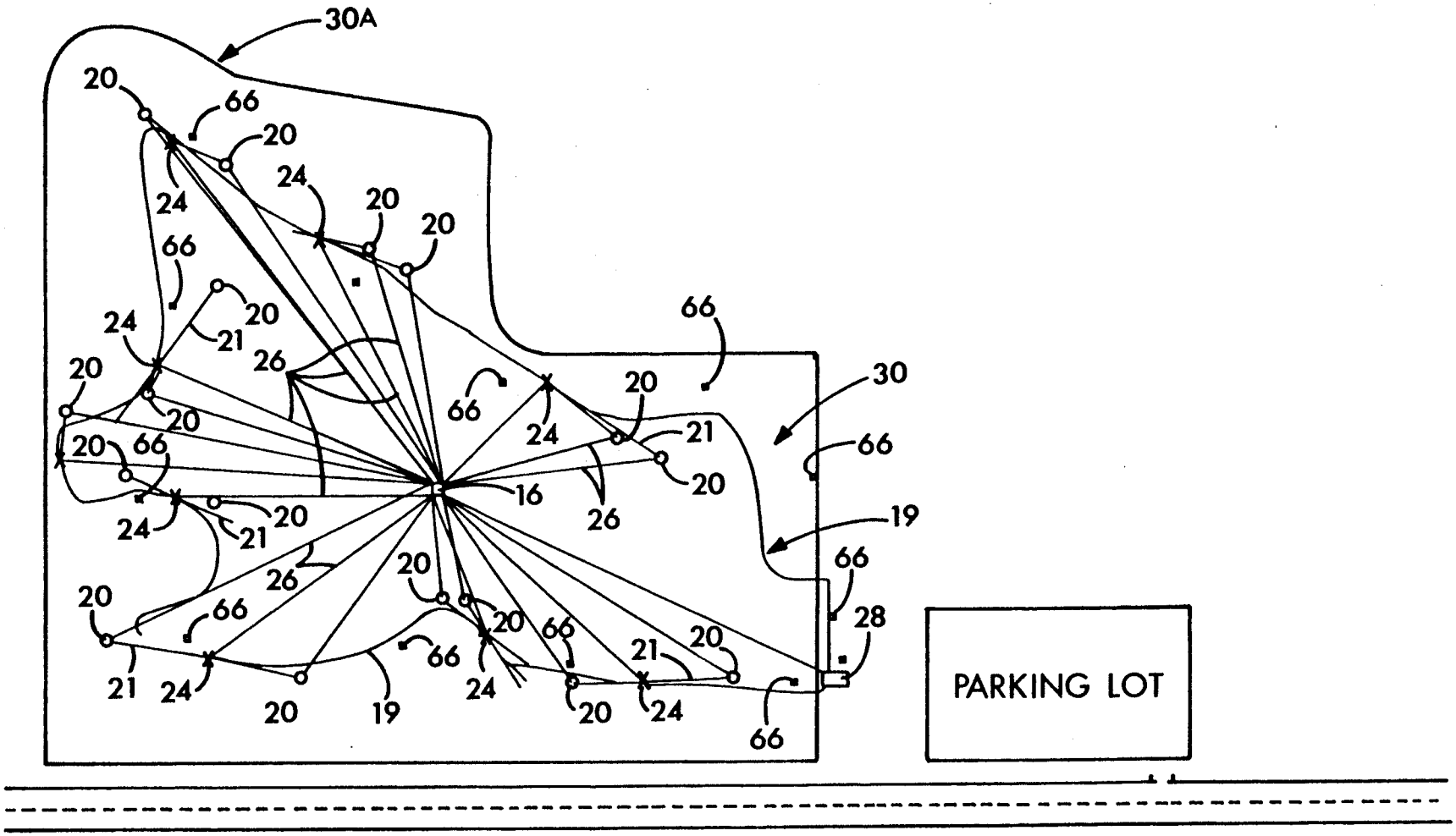
FIG. 6 is a top view of an outdoor course that may be used with the present invention.
Figure 7:
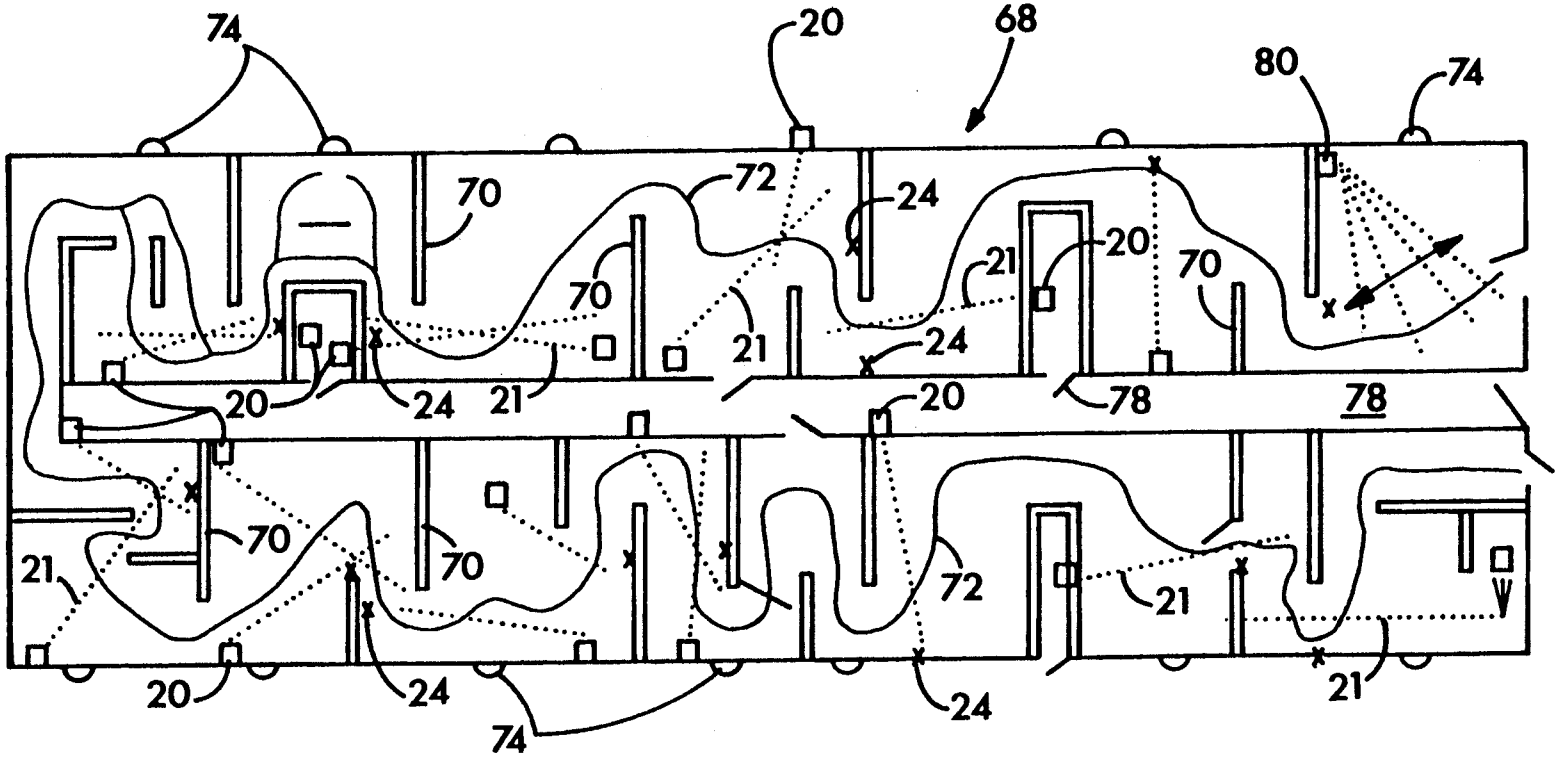
FIG. 7 is a top view of an indoor course that may be used with the present invention.

FIGS. 6 and 7 depict sample outdoor and indoor game courses respectively that may be used in the present invention. In the outdoor course depicted in FIG. 6, the player traverses course 30, tripping sensors 24 along the way. Sensors 24 are positioned so that firing lines 21 of one or more of targets 20 are located near their associated sensor 24, and thus are directed at the player who has tripped the sensor. Targets 20 may also have the ability to detect the position of the player and to follow the player as he moves in the vicinity of the target. This feature may be accomplished by equipping the targets with an infrared heat sink, a photoelectric or sonar sensor, or the like. The target would also include a servo motor and a track which would enable the target to move as it follows the player.

In FIG. 6, cables 26 connect the main PLC 16 with sensors 24 and targets 20. Border 30a defines the outer boundary of course 30. Scattered throughout the course are speakers 66, which produces suitable sound effects or background sounds. Speakers 66 are preferably operated from admissions building 28. Path 19 may be equipped with lighting to enable the game to be played at night.

FIG. 7 depicts an indoor course that may be used with the present invention. In FIG. 7, course 68 includes a plurality of walls 70 which define a path 72 that is traveled by the player. The course includes sensors 24, and targets 20 which fire along firing lines 21, indicated by the dotted lines. Course 68 also includes emergency exits 74, and doors 76 which are spaced along a hallway 78.

Indoor course 68, like the outdoor course, may also include a special type of target 80 that has a position-sensing feature which enables target 80 to sense the position of the player as he moves along path 72 and to fire items at him while the player is moving.

Although several embodiments of the present invention have been shown and described, alternate embodiments will be apparent to those skilled in the art and are within the intended scope of the present invention. Therefore, the invention is to be limited only by the following claims.

I claim:

1. A game, comprising:

a. a main controller having program instructions;

b. sensing means for sensing the presence of a player;

c. a plurality of targets, each of said targets including i. means for receiving control signals from said main controller;

ii. firing means for firing a first item toward a player;

iii. a target surface;

iv. means for detecting whether a player has successfully struck said surface with a second item; and d. means for computing a score based at least in part upon the number of times that said detection means detects that a player has successfully struck said surfaces with a second item.

2. The game of claim 1, wherein said targets further comprise:

a movable structural element; and means for moving said structural element in response to said control signals from said main controller.

3. The game of claim 1, wherein said targets further comprise:

target control means for controlling said firing means after the presence of a player is sensed by said sensing means.

4. The game of claim 3, wherein said target control means includes a programmable logic controller.

5. The game of claim 4, further comprising:

means for causing said main controller to operate said target control means in accordance with a plurality of skill levels.

6. The game of claim 1, wherein said sensing means senses the presence of a player near one of said targets.

7. The game of claim 1, wherein said sensing means includes a plurality of sensors, each of said sensors sensing the presence of a player near a target associated with the sensor.

8. The game of claim 7, wherein each of said sensors includes a photoelectric cell.

9. The game of claim 1, wherein said firing means includes:

a gun that fires ammunition; and a magazine that holds said ammunition.

10. The game of claim 1, further comprising:

means for informing said main controller that said sensing means has sensed the presence of a player.

11. The game of claim 1, wherein said detection means includes a proximity switch that is activated when said surface is struck by said second item.

12. The game of claim 11, wherein said second item is a paint ball.

13. A game, comprising:

a. a course on which a player travels;

b. a plurality of sensors that sense the presence of a player at selected places on said course;

c. a plurality of targets associated with said sensors, each of said targets including i. firing means for firing a first item toward a player whose presence has been sensed by a sensor associated with the target;

ii. a target surface perceivable by a player;

iii. means for detecting whether a player has successfully struck said target surface with a second item; and iv. a target control means having program instructions for controlling said firing means.

14. The game of claim 13, further comprising:

a main controller that generates a control signal; and wherein each of said targets further comprises:

a movable structural element; and means for moving said structural element in response to said control signal from said main controller.

15. The game of claim 14, wherein at least one of said sensors generates a sensor signal when said one sensor senses the presence of a player, and wherein said main controller generates said control signal to a target associated with said one sensor in response to said sensor signal.

16. The game of claim 14, wherein said control signal causes said target control means to operate said moving means.

17. The game of claim 14, wherein said moving means includes a motor.

18. The game of claim 13, wherein each of said target control means includes a programmable logic controller that is programmed with skill level information.

19. The game of claim 13, wherein said firing means fires said first item toward a player after a delay period if the player has not successfully struck said target surface.

* * * * *